US009428292B2

(12) United States Patent
Taber et al.

(10) Patent No.: US 9,428,292 B2
(45) Date of Patent: Aug. 30, 2016

(54) FLUID INJECTION SYSTEM AND METHOD FOR SUPPORTING CONTAINER WALLS

(71) Applicant: Silgan White Cap LLC, Downers Grove, IL (US)

(72) Inventors: James M. Taber, Aurora, IL (US); Kevin W. Orth, Des Plaines, IL (US); Dennis Szczesniak, Lemont, IL (US)

(73) Assignee: SILGAN WHITE CAP LLC, Downers Grove, IL (US)

( * ) Notice: Subject to any disclaimer, the term of this patent is extended or adjusted under 35 U.S.C. 154(b) by 676 days.

(21) Appl. No.: 13/801,124

(22) Filed: Mar. 13, 2013

(65) Prior Publication Data

US 2014/0260100 A1 Sep. 18, 2014

(51) Int. Cl.

| | |
|---|---|
| ***B65B 31/08*** | (2006.01) |
| ***B65B 31/06*** | (2006.01) |
| *B65B 3/00* | (2006.01) |
| *B65B 7/28* | (2006.01) |
| *B65D 41/04* | (2006.01) |

(52) U.S. Cl.

CPC ..... *B65B 31/08* (2013.01); *B65B 31/06* (2013.01); *B65D 41/045* (2013.01); *B65B 3/00* (2013.01); *B65B 7/2821* (2013.01); *B65D 41/0421* (2013.01)

(58) Field of Classification Search

CPC ... B65B 31/006; B65B 31/04; B65B 31/041; B65B 31/06; B65B 31/08; B65B 7/16; B65B 7/28; B65B 31/042; B65B 31/047; B65D 51/145; B65D 51/005; B65D 41/0435; B65D 41/20; B65D 41/22; B65D 41/30

USPC ..... 53/105, 403, 421–423, 432, 434, 436, 53/467, 471, 472; 215/247, 248

See application file for complete search history.

(56) References Cited

U.S. PATENT DOCUMENTS

| | | | | |
|---|---|---|---|---|
| 2,855,006 | A * | 10/1958 | Geisler | B65B 31/08 141/11 |
| 3,844,439 | A | 10/1974 | Demers et al. | |
| 4,279,350 | A | 7/1981 | King | |
| 4,499,931 | A | 2/1985 | Urban | |
| 4,560,077 | A | 12/1985 | Dutt | |
| 4,566,603 | A | 1/1986 | Moore | |
| 4,705,183 | A | 11/1987 | Moloney | |

(Continued)

FOREIGN PATENT DOCUMENTS

| | | |
|---|---|---|
| CA | 2 544 575 | 7/2012 |
| EP | 1 681 947 | 6/2011 |

(Continued)

OTHER PUBLICATIONS

U.S. Appl. No. 14/071,370, filed Nov. 4, 2013, Silgan White Cap LLC.

(Continued)

*Primary Examiner* — Stephen F Gerrity
*Assistant Examiner* — Joshua Kotis
(74) *Attorney, Agent, or Firm* — Reinhart Boerner Van Deuren S.C.

(57) ABSTRACT

A system and method for injecting pressurizing fluid into a filled and sealed container is provided. The container is filled with a product and is then sealed with a closure. A pressurizing fluid is injected through the closure into the container cavity after sealing and filling.

20 Claims, 8 Drawing Sheets

(56) References Cited

U.S. PATENT DOCUMENTS 4,796,770 A 1/1989 Begley
4,919,955 A * 4/1990 Mitchell ..... B65B 31/08 206/213.1
4,936,474 A 6/1990 Szczesniak et al.
4,981,230 A 1/1991 Marshall et al.
4,989,740 A 2/1991 Vercillo
5,027,964 A 7/1991 Banich
5,033,633 A 7/1991 Heilman
5,035,341 A 7/1991 Heilman et al.
5,077,111 A 12/1991 Collette
5,143,236 A * 9/1992 Gueret ..... B65B 31/047 215/247
5,152,412 A 10/1992 Iler
5,297,688 A 3/1994 Beck et al.
5,426,912 A 6/1995 Hall et al.
5,685,443 A 11/1997 Taber et al.
5,697,203 A * 12/1997 Niwa ..... B65B 25/001 53/510
5,804,237 A 9/1998 Diamon et al.
5,853,095 A 12/1998 Marshall et al.
6,056,136 A 5/2000 Taber
6,070,397 A * 6/2000 Bachhuber ..... B65B 31/08 141/329
6,182,715 B1 * 2/2001 Ziegler ..... B65B 31/006 141/285
6,375,023 B1 4/2002 Lecinski et al.
6,581,792 B1 6/2003 Limanjaya
6,677,397 B1 * 1/2004 Baranowski ..... B65D 41/34 524/488
6,779,672 B2 8/2004 Kano et al.
6,936,204 B2 8/2005 Al-Malaika
6,964,346 B1 11/2005 Taber et al.
7,159,374 B2 1/2007 Abercrombie, III et al.
7,264,131 B2 9/2007 Tsutsumi et al.
7,367,465 B2 5/2008 Taber et al.
7,575,121 B2 8/2009 Ooka et al.
7,607,547 B2 10/2009 Kumata et al.
7,637,082 B2 12/2009 Abercrombie, III et al.
7,850,029 B2 12/2010 Dreyer et al.
7,905,820 B2 3/2011 Druitt
7,942,287 B2 5/2011 King
8,043,552 B2 10/2011 Outreman
8,066,133 B2 11/2011 Takamatsu et al.
8,231,020 B2 7/2012 Taber et al.
8,281,945 B2 10/2012 Roussy et al.
8,365,934 B2 2/2013 Hamana et al.
8,365,946 B2 2/2013 Abercrombie et al.
8,807,360 B2 8/2014 Erspamer et al.
8,950,610 B2 2/2015 Schellenbach et al.
2002/0073652 A1 * 6/2002 Wiedemann ..... A23L 3/02 53/425
2005/0029219 A1 * 2/2005 Taber ..... B65D 1/0246 215/349
2005/0155325 A1 * 7/2005 Abercrombie, III ..... B65D 81/2046 53/401
2005/0194343 A1 9/2005 Sprishen
2006/0096661 A1 * 5/2006 Chaude ..... B65B 31/08 141/329
2006/0151423 A1 7/2006 Seidita
2006/0163193 A1 7/2006 Smeyak et al.
2007/0187352 A1 * 8/2007 Kras ..... B65D 41/0442 215/276
2009/0120038 A1 5/2009 Abercrombie, III et al.
2009/0223922 A1 9/2009 King
2009/0255929 A1 10/2009 Abercrombie, III et al.
2011/0089058 A1 4/2011 Abercrombie, III et al.
2011/0223070 A1 9/2011 Offord
2011/0290755 A1 12/2011 Taber et al.
2011/0318232 A1 12/2011 Patcheak
2012/0037589 A1 2/2012 King
2012/0261420 A1 10/2012 Taber et al.
2013/0112688 A1 5/2013 Krikor
2013/0205718 A1 8/2013 Kapolas
2013/0270272 A1 10/2013 Smith et al.
2014/0260100 A1 9/2014 Taber et al.
2014/0263335 A1 9/2014 Taber et al.
2014/0339191 A1 11/2014 Foroughi

FOREIGN PATENT DOCUMENTS

EP 2 397 419 A1 12/2011
EP 2 404 753 A1 1/2012
EP 2 479 116 7/2012
GB 1005651 9/1965
GB 1188170 4/1970
WO WO 99/05922 A1 2/1999
WO WO 2005/047760 5/2005
WO WO 2008/090354 A1 7/2008
WO WO 2010/115992 A1 10/2010
WO WO 2010/116192 A1 10/2010
WO WO 2010/116194 A1 10/2010
WO WO 2011/033146 A1 3/2011
WO WO 2011/112696 A2 9/2011
WO WO 2011/112775 A2 9/2011
WO WO 2011/163562 A2 12/2011
WO WO 2012/004261 A1 1/2012
WO WO 2012/104632 A1 8/2012
WO WO 2013/027049 A1 2/2013
WO WO 2013/087239 A1 6/2013

OTHER PUBLICATIONS

Documentazione Tecnica, User's Manual 026AZ010A, Plastic Cap Bending and Cutting Machine, FSM12L, published on Sep. 22, 2006, 104 pages.
U.S. Appl. No. 13/833,120, filed Mar. 15, 2013, Taber et al.

* cited by examiner

FLUID INJECTION SYSTEM AND METHOD FOR SUPPORTING CONTAINER WALLS

BACKGROUND OF THE INVENTION

The present invention relates generally to the field of container production. The present invention relates specifically to production of a container including injection of a fluid into the container to support the container wall.

SUMMARY OF THE INVENTION

One embodiment of the invention relates to a fluid injection method for pressurizing a filled and sealed food container. The method includes providing a container having an opening and cavity. The method includes filling the container cavity through the opening with a food product. The method includes sealing the opening with a closure. The method includes injecting a pressurizing fluid through the closure into the container cavity after sealing and filling.

Another embodiment of the invention relates to a fluid injection method for pressurizing a filled and sealed plastic beverage container. The method includes providing a plastic container having an opening and cavity. The method includes filling the container cavity through the opening with a food product. The method includes providing an injection molded thermoplastic closure, the closure includes a top panel, a skirt extending downward away from the top panel and thermoplastic elastomer liner coupled to a lower surface of the top panel. The method includes sealing the container opening with the closure, and the container has a first internal pressure following sealing of the container with the closure. The method includes inserting a nozzle through the thermoplastic elastomer liner and into the cavity of the plastic container. The method includes injecting a pressurizing fluid through the nozzle into the container cavity after sealing and filling. The method includes removing the nozzle from the thermoplastic elastomer liner. The thermoplastic elastomer liner self-seals forming a hermetic seal, and the container has a second internal pressure after injection of the pressurized fluid and removal of the nozzle. The second internal pressure is greater than the first internal pressure.

Another embodiment of the invention relates to a system for injecting pressurizing fluid into a filled and sealed plastic beverage container. The system includes an injection nozzle, a pressurized fluid source containing a pressurizing fluid and a conduit coupling the injection nozzle to the fluid source. The system includes an actuator coupled to the injection nozzle and configured to move the injection nozzle toward a closure sealing the plastic beverage container. The injection nozzle is configured to inject the pressurizing fluid through the closure into the plastic beverage container.

Alternative exemplary embodiments relate to other features and combinations of features as may be generally recited in the claims.

BRIEF DESCRIPTION OF THE DRAWINGS

This application will become more fully understood from the following detailed description, taken in conjunction with the accompanying figures, wherein like reference numerals refer to like elements in which.

DETAILED DESCRIPTION

Referring generally to the figures, various embodiments of a system and of a method for injecting a fluid (e.g., a sterile liquid, a sterile gas, an inert gas, nitrogen, etc.) into a filled and sealed container are shown. In addition, closures configured to facilitate fluid injection are also shown. In general, a container (e.g., a plastic beverage bottle) is filled with a fluid (e.g., a consumable beverage) and is then sealed by coupling a closure over the filling opening of the container. Following sealing of the container, an injection device injects a fluid through the closure into the cavity of the container. The injected fluid increases the pressure within the cavity of the container, and thereby the injected fluid acts to support the container walls against the inwardly directed forces that the walls of the container may experience (e.g., grasp force of the end user, air pressure, forces due to stacking in storage and transportation of the filled container). The closure used to seal the container may also include one or more elements or features configured to facilitate injection of the fluid through the closure. It is believed that by pressurizing the content cavity of the container following filling and sealing, improved sidewall support and more precisely controlled pressurization can be achieved as compared to pressurization methods in which the container is pressurized prior to sealing of the container with the closure.

Figure 1:
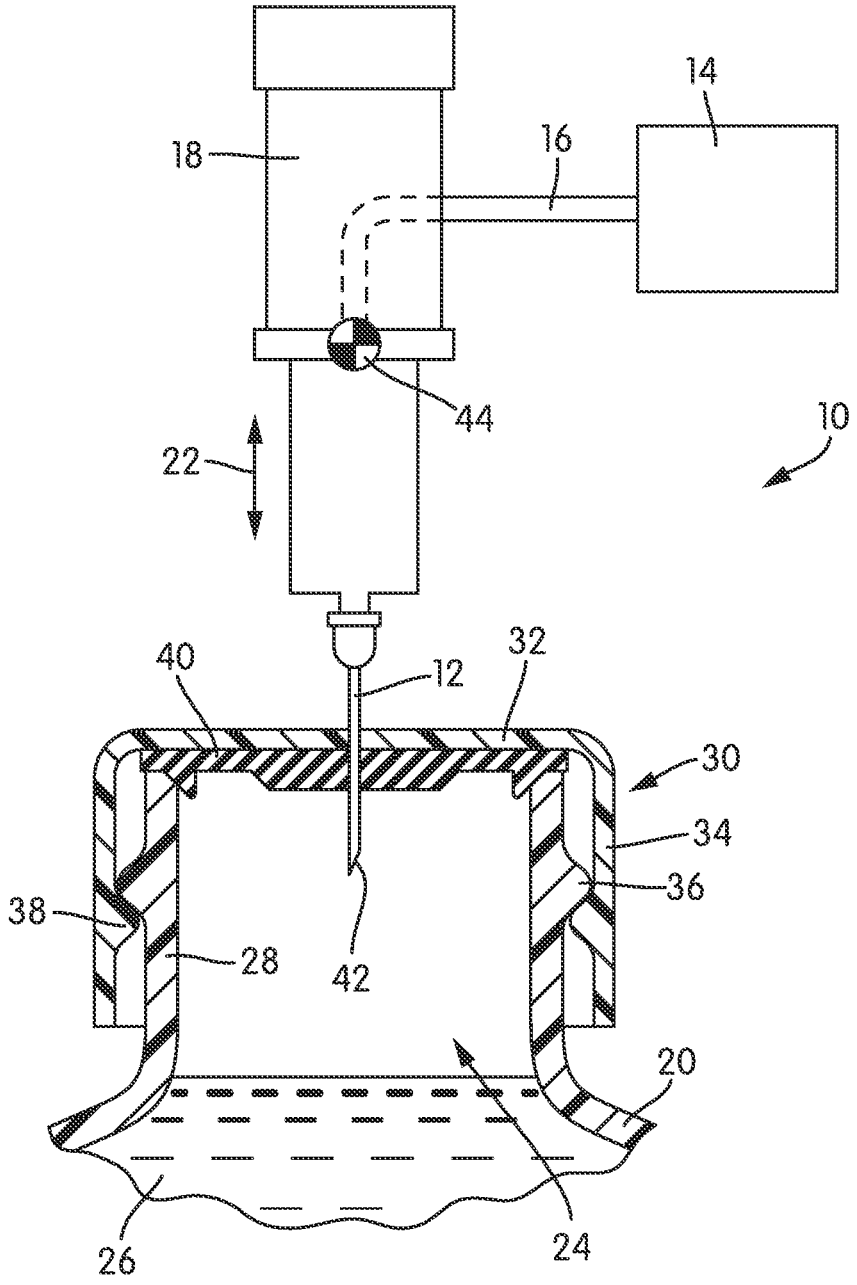
FIG. 1 is a fluid injection system according to an exemplary embodiment.

Referring to FIG. 1, a fluid injection system 10 is shown according to an exemplary embodiment. System 10 includes an injection nozzle, shown as piercing nozzle 12. Nozzle 12 is coupled to a pressurized fluid supply, shown as inert gas supply 14, via a conduit 16. Nozzle 12 is coupled to an actuator 18 configured to move nozzle 12 both toward and away from container 20 in the direction shown by arrow 22. Actuator 18 is a device configured to drive nozzle 12 downward with sufficient force to pierce a closure on a filled and sealed container. In various embodiments, actuator 18 is a machine driven actuator, and in one embodiment, is a hydraulic piston and in another embodiment is a gas piston.

As shown in FIG. 1, fluid injection system 10 is configured to inject fluid into a sealed and filled container 20. In the embodiment, shown container 20 includes a cavity 24, and content, shown as fluid 26, is located within cavity 24. Container 20 includes a neck 28, and a closure 30 is coupled to neck 28. The filling opening located at the upper end of neck 28 of container 20 is sealed by closure 30 after container 20 is filled with fluid 26. Closure 30 includes a top wall, shown as upper panel 32, and a skirt 34 extending downward away from and substantially perpendicular to upper panel 32. Closure 30 includes threads 38 formed on the inner surface of skirt 34 that engage mating threads 36 formed on the outer surface of neck 28.

Closure 30 includes a seal or gasket 40 coupled to the lower surface of upper panel 32. Gasket 40 is formed from a compliant polymer material capable of forming a fluid and air tight seal against the upper rim of container neck 28. In various embodiments, gasket 40 is formed from a thermoplastic elastomer (TPE) material, and upper panel 32 and skirt 34 are formed from a relatively rigid thermoplastic material (e.g., polypropylene, high density polyethylene, etc.).

To inject fluid into container 20 using fluid injection system 10, container 20 is placed beneath nozzle 12 when nozzle 12 is in a refracted position. With container 20 in place beneath nozzle 12, actuator 18 drives nozzle 12 downward, piercing upper panel 32 and gasket 40 with nozzle 12. In various embodiments, actuator 18 is a mechanically operated machine configured to move the tip of nozzle 12 a precise distance to pierce upper panel 32 and gasket 40. Thus, actuator 18 is configured to move the tip of nozzle 12 at least the combined thickness of upper panel 32 and gasket 40. In various embodiments, actuator 18 is configured to move the tip of nozzle 12 0.010 inches more than the combined thicknesses of the panel and liner embodiments discussed herein. In various embodiments, actuator 18 is configured to move the tip of nozzle 12 between 0.020 inches and 0.150 inches, specifically between 0.020 inches and 0.120 inches and more specifically between 0.020 inches and 0.110 inches.

As shown in FIG. 1, nozzle 12 passes through upper panel 32 and gasket 40, and tip 42 of nozzle 12 is located within cavity 24 following piercing of upper panel 32 and gasket 40. Following insertion of nozzle 12, gas supply 14 is operated to inject gas through conduit 16 and nozzle 12 into cavity 24 to pressurize cavity 24 of container 20. In one embodiment, a valve 44 is provided at the input side of nozzle 12, and valve 44 is opened to allow gas from gas supply 14 to flow into cavity 24. In one embodiment, gas supply 14 is a pressurized container of gas such that opening of valve 44 allows the gas from gas supply 14 to flow into container 20. In another embodiment, gas supply 14 includes a high pressure pump or compressor configured to pressurize the gas, and in this embodiment the pump is configured to pressurize the gas once nozzle 12 is placed into cavity 24 to deliver gas from gas supply 14 to cavity 24. In various embodiments, valve 44 is an electronically controlled valve controlled to open following insertion of the nozzle into container 20. In one such embodiment, valve 44 is a solenoid actuated check valve controlled by an electronic control system (e.g., one or more computers, processing circuitry, microprocessors, etc.) that is configured to control system 10 to provide the functionality discussed herein.

Once the desired volume of gas has been delivered, nozzle 12 is retracted by actuator 18. With nozzle 12 removed, the compliant material of gasket 40 self-seals forming an air tight seal. The injected gas acts to fill the volume of the container not filled by fluid 26, and in some embodiments may bring the pressure within container 20 slightly above atmospheric pressure. In such embodiments, addition of the fluid injected through nozzle 12 acts to raise the pressure within the container to support the walls of container 20. Thus, container 20 after filling and sealing, but prior to injection of the fluid has an internal pressure (a first internal pressure), and container 20 has an internal pressure (a second internal pressure) after injection of the fluid that is greater that the first internal pressure.

In certain thin-walled containers, the containers may be originally filled with a content fluid (e.g., fluid 26) at atmospheric pressure, but the radial strength of the sidewall of the container is too low to prevent inward buckling of the sidewall when the container is handled by the end user, handling during shipping or stacking. In addition, some containers are originally filled with a hot or warm content fluid (e.g., fluid 26), and in such containers, the pressure within the sealed container decreases as the temperature of the contents of the container cool following sealing by the closure. In these embodiments, the gas injected by system 10 acts to support the walls of the container from the various radially inwardly directed forces.

In the embodiment shown, system 10 is configured to deliver a gas into container 20. In various embodiments, the gas delivered by system 10 is a sterile inert gas, and in one specific embodiment, is sterile nitrogen gas. In another embodiment, system 10 is configured to deliver a sterile non-oxygen-containing gas into container 20. In another embodiment, the fluid supplied by system 10 is a liquid fluid delivered in sufficient volume to fill the remaining volume of container 20 above fluid 26.

In various embodiments, the volume of fluid delivered is selected to fill the remaining empty volume of container 20 above fluid 26. In various embodiments, the amount of fluid injected into container 20 varies based on the size of container 20 and the fill level of fluid 26 within container 20. In one embodiment, system 10 is configured to deliver approximately 30 cubic centimeters (as measured at standard temperature and pressure) of inert gas, specifically nitrogen, into container 20. In another embodiment, system 10 is configured to deliver between 20 cubic centimeters and 40 cubic centimeters (as measured at standard temperature and pressure) of inert gas, specifically nitrogen, into container 20.

While the disclosure herein relates primarily to plastic beverage containers, the systems, structures and methods discussed herein could be used to inject a fluid or inert gas into a wide variety of sealed containers. For example, in one embodiment, structures and methods discussed herein could be used to inject a fluid or inert gas into a hermetically sealed pouch container (e.g., a juice pouch container). Further, as shown in FIG. 1, nozzle 12 is a needle shaped piercing nozzle. In other embodiments, other nozzles may be used. In one embodiment, closure 30 includes a valve through the upper panel, and the nozzle of system 10 is configured to open the valve to inject fluid into container 20. In another embodiment, system 10 is configured to generate a high-speed fluid jet that directly pierces upper panel 32 and gasket 40.

Figure 2:
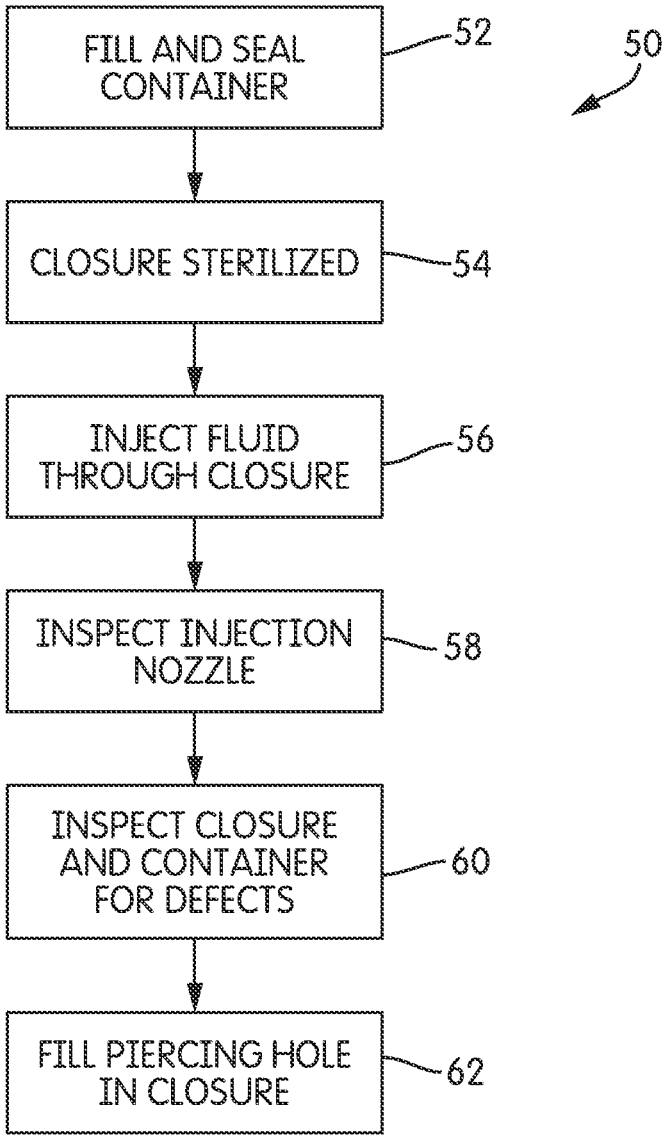
FIG. 2 shows a method of injecting fluid into a filled container according to an exemplary embodiment.

Referring to FIG. 2, a process 50 for injecting a fluid into a filled and sealed container is shown according to an exemplary embodiment. At step 52, a container, such as plastic container 20 discussed above, is filled and hermetically sealed. In one embodiment, the container is sealed with a closure such as closure 30 discussed above.

At step 54, the closure is sterilized prior to injecting fluid through the closure. Sterilization at step 54 can be implemented through exposure of the filled container and closure to UV light, an antiseptic chemical wash (e.g., antimicrobial fluid), flame, plasma, steam and/or hot water.

At step 56 fluid is injected through the closure as discussed above regarding FIG. 1 to support the walls of the container. In one embodiment, a predetermined volume of fluid is injected into the container utilizing a positive displacement meter to measure the volume of fluid injected. In various embodiments the fluid injected is an inert gas, such as nitrogen. In other embodiments, the fluid injected is a displacement liquid. In various embodiments, injection occurs via piercing the top panel of the closure with a needle-like piercing nozzle, via high-pressure liquid jet, or via nozzle engagement with valve in closure.

At step 58 the injection nozzle used to inject fluid through the closure is inspected for defects. In one embodiment, step 58 is performed after each step 56. In various embodiments, inspection of the nozzle may be via an electronic vision system, laser scan device, proximity sensor or contact sensor. In this embodiment, if a defect, such as a broken, cracked or missing injection nozzle is detected an error message may be provide to the operator of the injection system or the system may be stopped allowing the appropriate repairs to be made.

At step 60, in those embodiments that involve piercing of the closure via the nozzle, the container and closure are inspected for defects that might occur during the injection step. Specifically, in one embodiment, step 60 checks to confirm that no portion of the injection nozzle has broken into the container or has been left in the closure. In various embodiments, the inspection at step 60 occurs via use of a vision system, magnetic metal detection, x-ray scanning or RF scanning to detect whether any portion of the injection nozzle has been left in the container or closure.

At step 62, in those embodiments that involve piercing of the closure via the nozzle, the top panel of the closure may be modified to remove visual indication of piercing. In one embodiment, the hole created through the upper panel of the closure by the nozzle (e.g., the injection hole) may be sealed by melting the thermoplastic material adjacent the hole. In various embodiments, melting may be generated via use of a laser welding tool, a heat-based welding tool or an ultrasonic welding tool. In another embodiment, at step 62, a melted thermoplastic or adhesive may be applied to cover the injection hole. It should be noted that in an embodiment in which the closure includes a self-sealing gasket, such as gasket 40 discussed above, filling of the injection hole at step 62 is not needed to hermetically seal the closure because, as discussed above, the hermetic seal of the container is reformed upon withdrawal of the piercing nozzle due to the self-sealing characteristic of gasket 40.

In various embodiments, the system shown in FIG. 1 and the process shown in FIG. 2 is implemented via automated container processing equipment. In one specific embodiment, the system shown in FIG. 1 and the process shown in FIG. 2 is implemented via rotating continuous motion machinery.

In various embodiments, the closures of the containers used in the systems and methods discussed herein include one or more features configured to facilitate injection of fluid through the closure into the container. For example, in various embodiments, the thickness of the relatively rigid thermoplastic top panel of the closure is made to permit piercing by the piercing nozzle of the injection system, and/or the thickness of the compliant liner or gasket is made to effectively self-seal to form a hermetic seal upon withdrawal of the piercing nozzle. In other embodiments, the closure may include an injection window or area that is a thinned central portion of the closure top panel made to permit piercing by the piercing nozzle of the injection system. In other embodiments, the closure may include an injection window or area that is a central bore formed through the closure top panel filled with the compliant gasket material made to permit piercing by the piercing nozzle of the injection system and to provide self-sealing. Various exemplary embodiments of such closures are shown in FIGS. 3-13.

Figure 3:
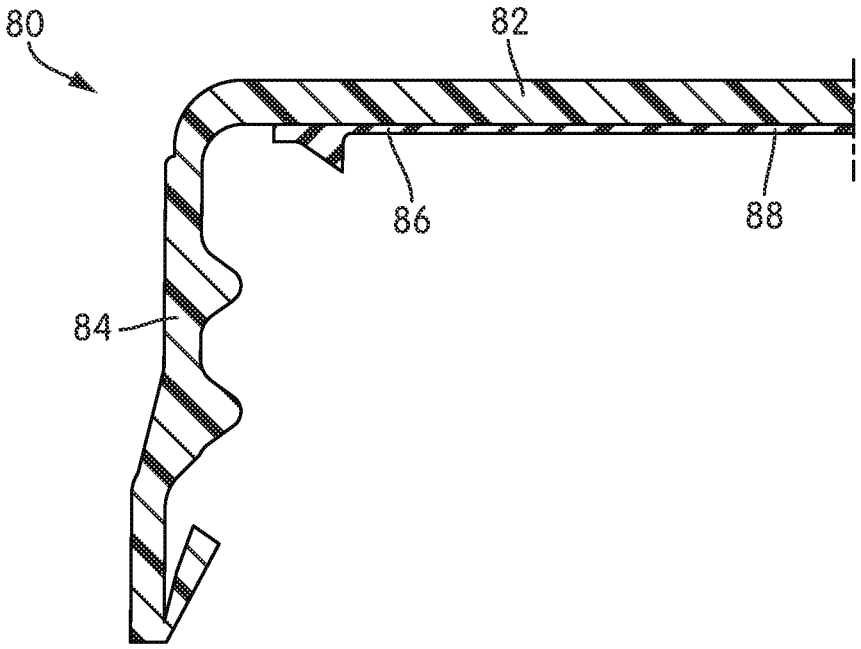
FIG. 3 is a closure used with the system of FIG. 1 according to an exemplary embodiment.

Referring specifically to FIG. 3, a closure 80 is shown. Closure 80 includes a top panel 82 and a skirt 84 extending downward away from top panel 82. Closure 80 includes a gasket or liner 86 coupled to the lower surface of top panel 82. In various embodiments, liner 86 is formed from a compliant polymer material that self-seals (e.g., a thermoplastic elastomer material), and upper panel 82 and skirt 84 are formed from a relatively rigid thermoplastic material (e.g., polypropylene, high density polyethylene, etc.). In the embodiment shown, the thickness of top panel 82 is selected such that the piercing nozzle (e.g., piercing nozzle 12) is able to easily penetrate through top panel 82. In various embodiments, the thickness of top panel 82 is substantially the same across the diameter of closure 80 and is between 0.010 inches and 0.060 inches and more specifically is between 0.020 inches and 0.040 inches. In one embodiment, the thickness of top panel 82 is substantially the same across the diameter of closure 80 and is 0.050 inches plus or minus 0.003 inches. In another embodiment, the thickness of top panel 82 is substantially the same across the diameter of closure 80 and is 0.030 inches plus or minus 0.003 inches. In another embodiment, the thickness of top panel 82 is substantially the same across the diameter of closure 80 and is 0.010 inches plus or minus 0.003 inches In the embodiment shown, the thickness of central liner portion 88 of liner 86 is selected to provide for hermetic self-sealing upon withdrawal of the piercing nozzle of the fluid injection system. In various embodiments, the thickness of central liner portion is between 0.010 inches and 0.110 inches, specifically 0.010 inches and 0.050 inches, and more specifically is between 0.010 inches and 0.030 inches. In various embodiments, the thickness of central liner portion is between 0.020 inches and 0.110 inches, specifically 0.020 inches and 0.100 inches, and more specifically is between 0.020 inches and 0.080 inches. In one specific embodiment, the thickness of central liner portion is 0.010 inches plus or minus 0.003 inches. In another specific embodiment, the thickness of central liner portion is 0.020 inches plus or minus 0.003 inches. In another specific embodiment, the thickness of central liner portion is 0.040 inches plus or minus 0.003 inches.

Figure 4:
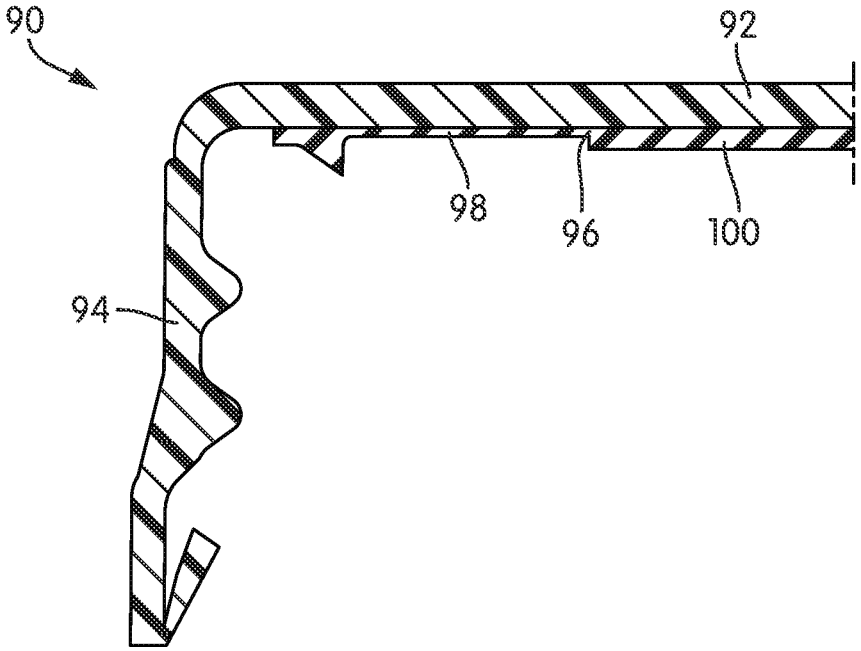
FIG. 4 is a closure used with the system of FIG. 1 according to an exemplary embodiment.

Referring to FIG. 4, a closure 90 is shown. Closure 90 includes a top panel 92 and a skirt 94 extending downward away from top panel 92. Closure 90 is substantially the same as closure 80 except for the design of self-sealing liner 96. Liner 96 is formed from a compliant polymer material that self-seals (e.g., a thermoplastic elastomer material). Liner 96 includes an thin outer portion 98 and a thick central portion 100. Thick portion 100 of liner 96 is centrally located below the central region of top panel 92 through which the injection nozzle passes. Thick portion 100 is thickened in the region of piercing to provide improved self-sealing of liner 96.

In various embodiments, the thickness of thickened liner portion 100 is between 0.015 inches and 0.060 inches, and more specifically is between 0.020 inches and 0.050 inches. In one specific embodiment, the thickness of liner portion 100 is 0.020 inches plus or minus 0.003 inches. In another specific embodiment, the thickness of liner portion 100 is 0.030 inches plus or minus 0.003 inches. In another specific embodiment, the thickness of liner portion 100 is 0.040 inches plus or minus 0.003 inches. In one embodiment, the thickness of central liner portion 100 is more than twice the thickness of outer liner portion 98. In various embodiments, the thickness of thickened liner portion 100 is between 0.010 inches and 0.110 inches, specifically 0.010 inches and 0.050 inches, and more specifically is between 0.010 inches and 0.030 inches. In various embodiments, the thickened liner portion 100 is between 0.020 inches and 0.110 inches, specifically 0.020 inches and 0.100 inches, and more specifically is between 0.020 inches and 0.080 inches.

Figure 5:
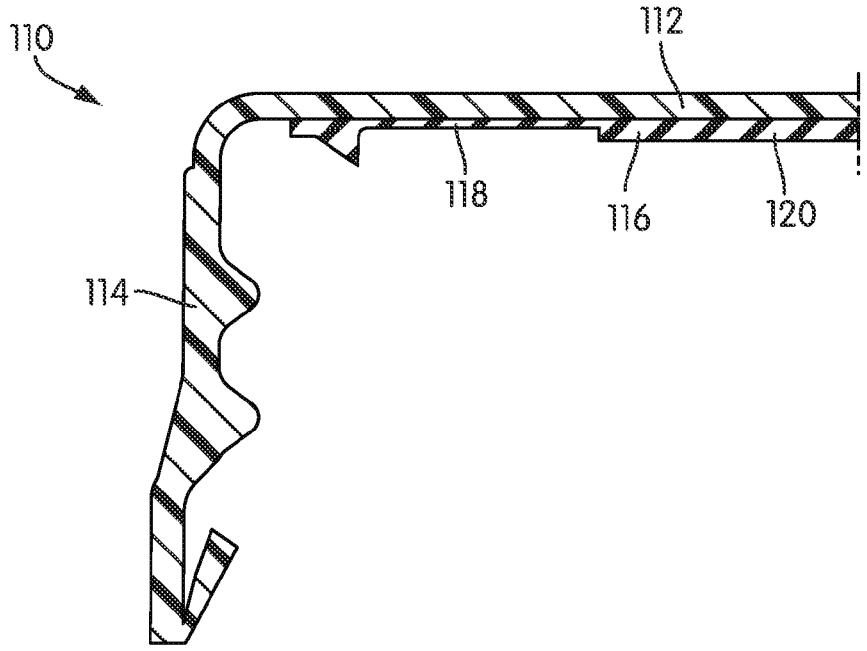
FIG. 5 is a closure used with the system of FIG. 1 according to an exemplary embodiment.

Referring to FIG. 5, a closure 110 is shown. Closure 110 includes a top panel 112, a skirt 114 extending downward away from top panel 112, and a liner 116. Liner 116 includes a thin outer portion 118 and liner center portion 120. Closure 110 is substantially the same as closure 90 except for the thickness of top panel 112. As shown in FIG. 5, top panel 112 is thinner relative to the liner center portion 120 than the corresponding portions of closure 90. In this embodiment, top panel 112 has substantially the same thickness as liner center portion 120. In various embodiments, the thickness of top panel 112 and of liner center portion 120 are substantially the same as each other (e.g., within 0.003 inches of each other), and the thickness of both is between 0.015 inches and 0.060 inches, and more specifically is between 0.015 inches and 0.050 inches. In one specific embodiment, the thickness of both top panel 112 and liner center portion 120 is 0.020 inches plus or minus 0.003 inches. In another specific embodiment, the thickness of both top panel 112 and liner center portion 120 is 0.030 inches plus or minus 0.003 inches. In another specific embodiment, the thickness of both top panel 112 and liner center portion 120 is 0.010 inches plus or minus 0.003 inches.

Figure 6:
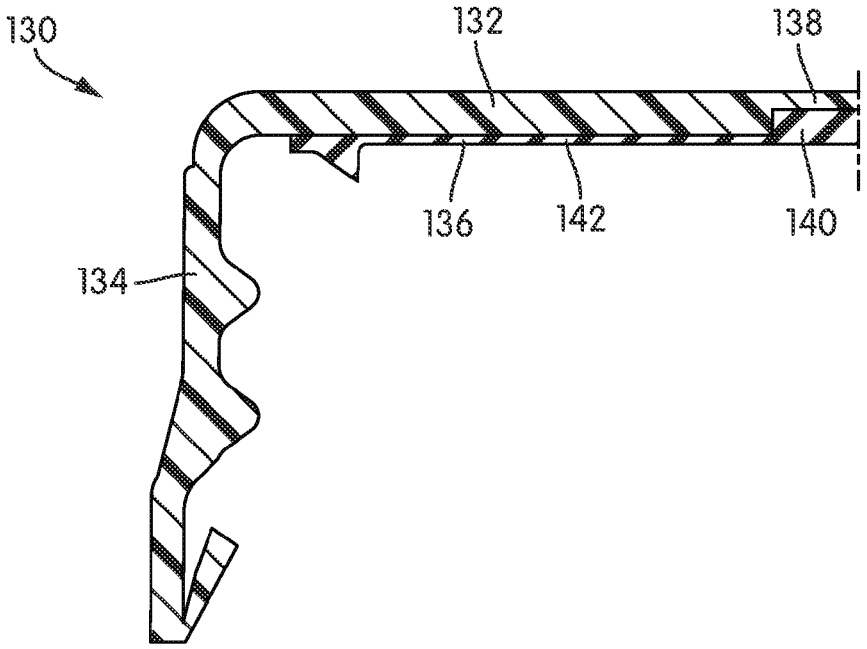
FIG. 6 is a closure used with the system of FIG. 1 according to an exemplary embodiment.

Referring to FIG. 6, a closure 130 is shown. Closure 130 includes a top panel 132, a skirt 134 extending downward away from top panel 132, and a liner 136. Closure 130 is substantially the same as closure 80 shown in FIG. 3 except that top panel 132 includes a thinned central portion 138. Relative to the lower surface of top panel 132, thinned central portion 138 is a recess formed at the center of top panel 132. As shown, the lower surface of liner 136 is substantially planar, however a central portion 140 of liner 136 is thicker than outer portion 142, and central portion 140 fills in the recess formed by the thinned central portion 138.

In various embodiments, the thickness of thinned central portion 138 is less than one half the thickness of the outer portion of top panel 132. In such embodiments, the thickness of central portion 138 is between 0.005 inches and 0.040 inches, and more specifically is between 0.005 inches and 0.025 inches. In one embodiment, the thickness of central portion 138 is 0.020 inches plus or minus 0.003 inches. In another embodiment, the thickness of central portion 138 is 0.010 inches plus or minus 0.003 inches.

In various embodiments, the thickness of central liner portion 140 is between 0.015 inches and 0.060 inches, and more specifically is between 0.015 inches and 0.050 inches. In one specific embodiment, the thickness of central liner portion 140 is 0.020 inches plus or minus 0.003 inches. In another specific embodiment, the central liner portion 140 is 0.030 inches plus or minus 0.003 inches. In another specific embodiment, the thickness central liner portion 140 is 0.040 inches plus or minus 0.003 inches. In one embodiment, the thickness of central liner portion 140 is more than twice the thickness of outer liner portion 142. In various embodiments, the thickness of central liner portion 140 is between 0.010 inches and 0.110 inches, specifically 0.010 inches and 0.050 inches, and more specifically is between 0.010 inches and 0.030 inches. In various embodiments, the central liner portion 140 is between 0.020 inches and 0.110 inches, specifically 0.020 inches and 0.100 inches, and more specifically is between 0.020 inches and 0.080 inches.

Figure 7:
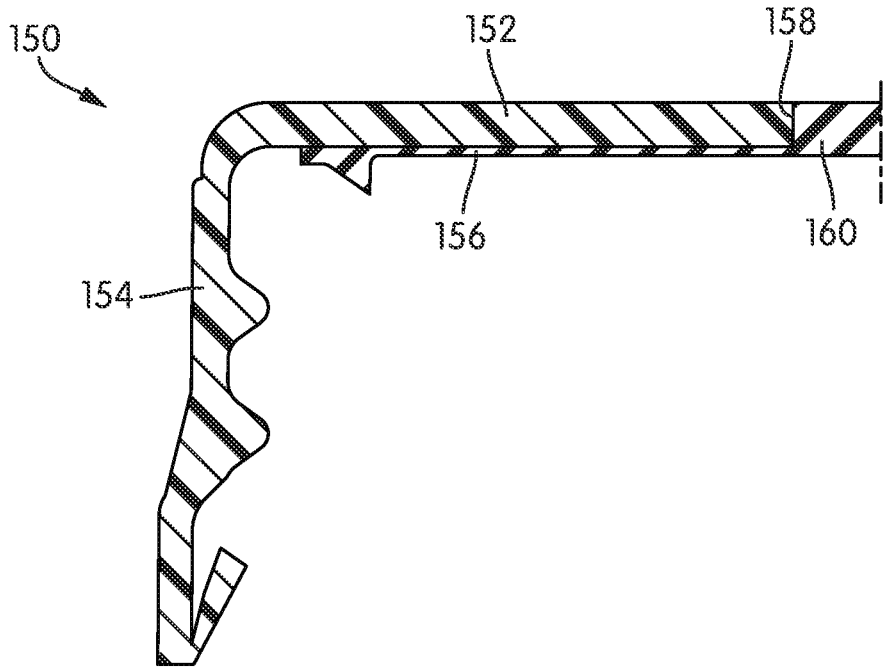
FIG. 7 is a closure used with the system of FIG. 1 according to an exemplary embodiment.

Referring to FIG. 7, a closure 150 is shown. Closure 150 includes a top panel 152, a skirt 154 extending downward away from top panel 152, and a liner 156. Closure 150 is substantially the same as closure 130 shown in FIG. 6 except that top panel 152 includes a central bore 158. Liner 156 includes a central portion 160 that extends through the central bore 158 such that the outer surface of central liner portion 160 is substantially coplanar with the outer surface of top panel 152. This embodiment provides a central window or passage filled with the compliant polymer material of the liner to facilitate the passage of the injection nozzle into the container.

In various embodiments, the thickness of central liner portion 160 is between 0.015 inches and 0.060 inches, and more specifically is between 0.015 inches and 0.050 inches. In one specific embodiment, the thickness of central liner portion 160 is 0.020 inches plus or minus 0.003 inches. In another specific embodiment, the thickness of central liner portion 160 is 0.030 inches plus or minus 0.003 inches. In another specific embodiment, the thickness of central liner portion 160 is 0.040 inches plus or minus 0.003 inches. In another specific embodiment, the thickness of central liner portion 160 is 0.050 inches plus or minus 0.003 inches. In one embodiment, the thickness of central liner portion 160 is more than twice the thickness of the outer liner portion and more than twice the thickness of top wall 152. In various embodiments, the thickness of central liner portion 160 is between 0.010 inches and 0.110 inches, specifically 0.010 inches and 0.050 inches, and more specifically is between 0.010 inches and 0.030 inches. In various embodiments, the central liner portion 160 is between 0.020 inches and 0.110 inches, specifically 0.020 inches and 0.100 inches, and more specifically is between 0.020 inches and 0.080 inches.

Figure 8:
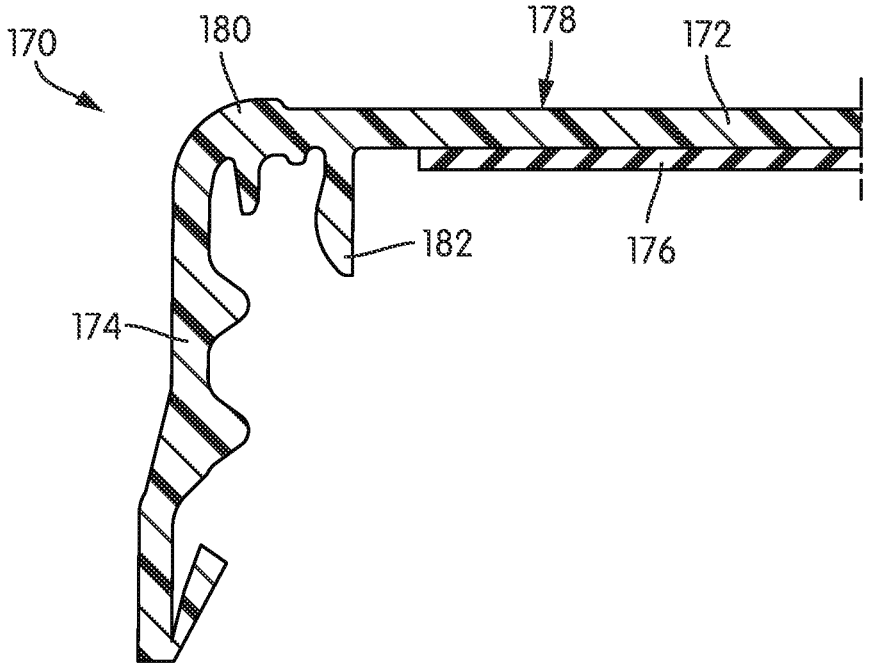
FIG. 8 is a closure used with the system of FIG. 1 according to an exemplary embodiment.

Referring to FIG. 8, a closure 170 is shown. Closure 170 includes a top panel 172, a skirt 174 extending downward away from top panel 172, and a liner 176. Closure 170 includes a recess 178 formed in top panel 172 that is recessed below the upper most edge of shoulder 180. Closure 170 also includes a peripheral sealing rib 182. Similar to the embodiments discussed above, liner 176 acts as a self-sealing structure to reseal closure 170 following the withdrawal of the injection nozzle.

In various embodiments, the thickness of at least the center portion of liner 176 is between 0.015 inches and 0.060 inches, and more specifically is between 0.015 inches and 0.050 inches. In one specific embodiment, the thickness of liner portion 176 is 0.020 inches plus or minus 0.003 inches. In another specific embodiment, the thickness of liner 176 is 0.030 inches plus or minus 0.003 inches. In another specific embodiment, the thickness of liner 176 is 0.040 inches plus or minus 0.003 inches. In various embodiments, the thickness of central liner portion 176 is between 0.010 inches and 0.110 inches, specifically 0.010 inches and 0.050 inches, and more specifically is between 0.010 inches and 0.030 inches. In various embodiments, the central liner portion 176 is between 0.020 inches and 0.110 inches, specifically 0.020 inches and 0.100 inches, and more specifically is between 0.020 inches and 0.080 inches.

Figure 9:
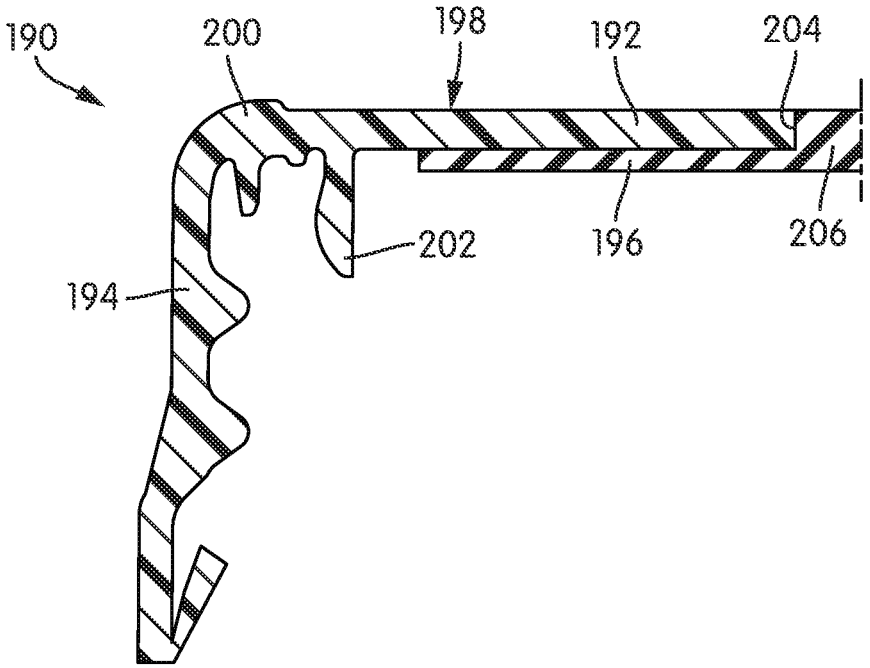
FIG. 9 is a closure used with the system of FIG. 1 according to an exemplary embodiment.

Referring to FIG. 9, a closure 190 is shown. Closure 190 includes a top panel 192, a skirt 194 extending downward away from top panel 192, and a liner 196. Closure 190 includes a recess 198 formed in top panel 192 that is recessed below the upper most edge of shoulder 200. Closure 190 also includes a peripheral sealing rib 202. Similar to the embodiments discussed above, liner 196 acts as a self-sealing structure to reseal closure 190 following the withdrawal of the injection nozzle.

Similar to closure 160 shown in FIG. 7, top panel 192 includes a central bore 204. Liner 196 includes a central portion 206 that extends through the central bore 204 such that the outer surface of central liner portion 206 is substantially coplanar with the outer surface of top panel 192. This embodiment provides a central window or passage filled with the compliant polymer material of the liner to facilitate the passage of the injection nozzle into the container.

In various embodiments, the thickness of central liner portion 206 is between 0.015 inches and 0.060 inches, and more specifically is between 0.015 inches and 0.050 inches. In one specific embodiment, the thickness of central liner portion 206 is 0.020 inches plus or minus 0.003 inches. In another specific embodiment, the thickness of central liner portion 206 is 0.030 inches plus or minus 0.003 inches. In another specific embodiment, the thickness of central liner portion 206 is 0.040 inches plus or minus 0.003 inches. In another specific embodiment, the thickness of central liner portion 206 is 0.050 inches plus or minus 0.003 inches. In one embodiment, the thickness of central liner portion 206 is more than twice the thickness of the outer liner portion and more than 1.5 times the thickness of top wall 192. In various embodiments, the thickness of central liner portion 206 is between 0.010 inches and 0.110 inches, specifically 0.010 inches and 0.050 inches, and more specifically is between 0.010 inches and 0.030 inches. In various embodiments, the central liner portion 206 is between 0.020 inches and 0.110 inches, specifically 0.020 inches and 0.100 inches, and more specifically is between 0.020 inches and 0.080 inches.

As noted above, in some embodiments, injection system 10 may be configured to inject fluid into a sealed container without piercing the top wall or the liner of the closure. In some embodiments, the injection nozzle of system 10 may engage with a valve structure located in the top wall of the closure. In such embodiments, the valve structure is a one way valve that permits fluid to be injected through the valve but prevents fluid from escaping out of the container. In one embodiment, the valve in the closure is configured to only open a single time, and, in this embodiment, the valve will permanently seal closed following injection of the pressurizing fluid through the valve and into the container.

Figure 10:
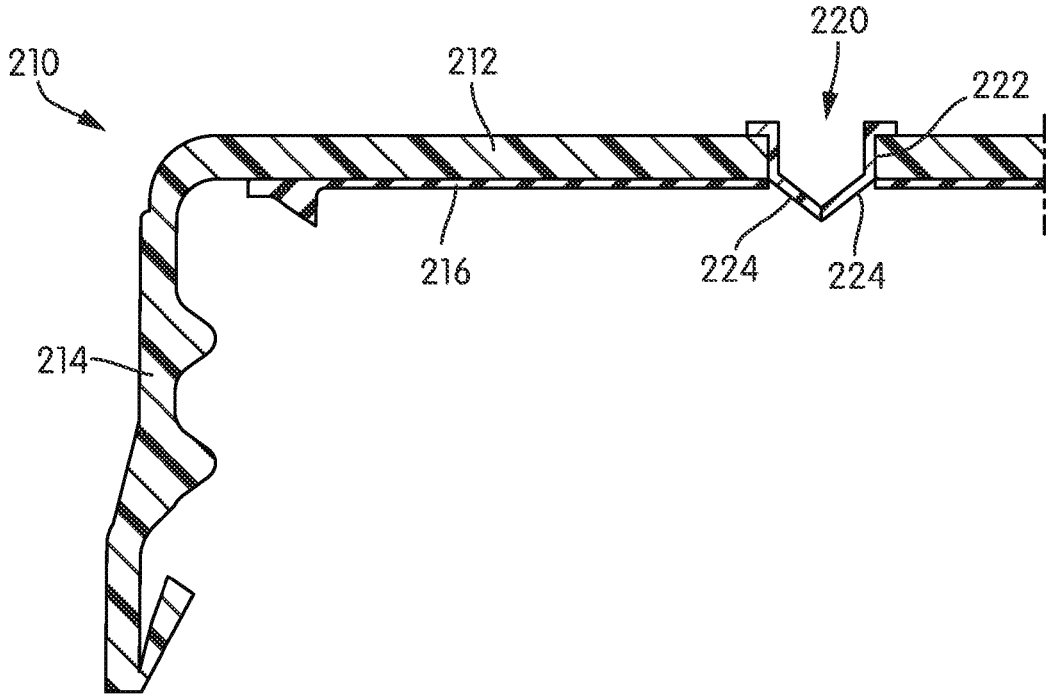
FIG. 10 is a closure used with the system of FIG. 1 according to an exemplary embodiment.

Referring to FIG. 10, closure 210 includes a top panel 212, a skirt 214 extending downward away from top panel 212 and a liner 216. Closure 210 is substantially the same as closure 80, shown in FIG. 3, except that closure 210 includes a valve, shown as flap valve 220, coupled to a through bore 222 formed in top panel 212. Valve 220 includes flaps 224 that are biased to the closed position shown FIG. 10. Upon application of sufficient pressure to the outer surface of valve 220 by the fluid injection nozzle of system 10, flaps 224 open allowing the injected fluid to flow into the container. Once filling is completed and the pressure supplied by the injection nozzle is removed, flaps 224 snap back to the closed position shown in FIG. 10 hermetically sealing closure 210.

Figure 11:
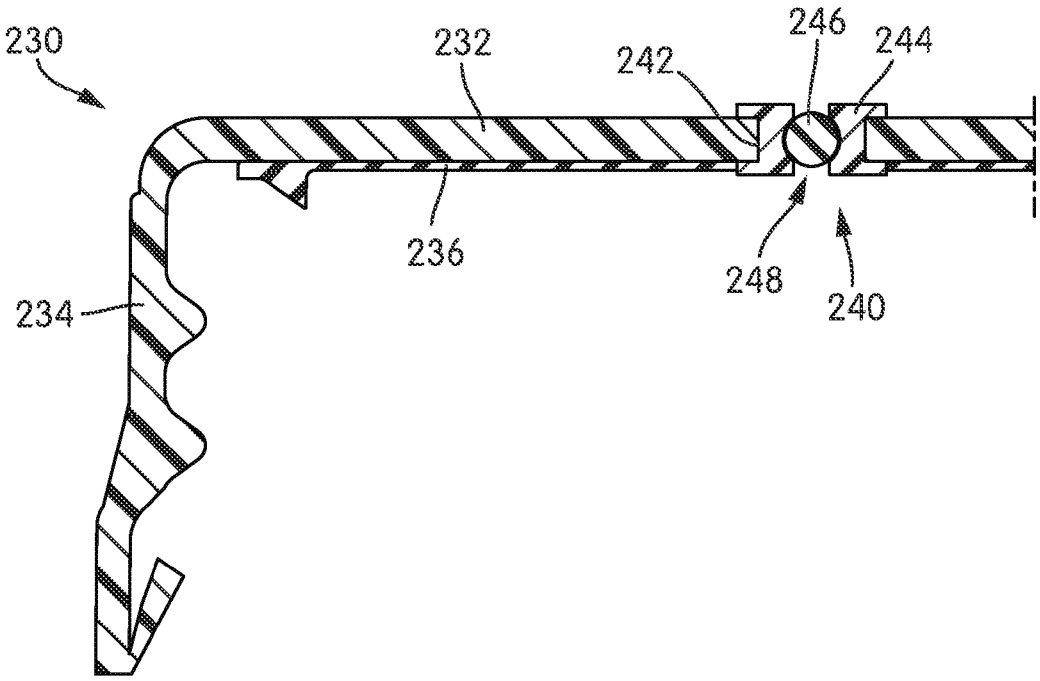
FIG. 11 is a closure used with the system of FIG. 1 according to an exemplary embodiment.

Referring to FIG. 11, closure 230 includes a top panel 232, a skirt 234 extending downward away from top panel 232 and a liner 236. Closure 230 is substantially the same as closure 80, shown in FIG. 3, except that closure 230 includes a valve, shown as ball check valve 240, coupled to a through bore 242 formed in top panel 232. Valve 240 includes an outer collar 244 and a ball 246. Outer collar 244 couples to the inner edge of bore 242, and collar 244 includes a central channel 248. Ball 246 is located within central channel 248 and is moveable between opened and closed positions. Ball 246 is biased to the closed position shown FIG. 11. Upon application of sufficient pressure to the outer surface of valve 240 by the fluid injection nozzle of system 10, ball 246 moves downward to the open position allowing the injected fluid to flow into the container. Once filling is completed and the pressure supplied by the injection nozzle is removed, ball 246 snaps back to the closed position shown in FIG. 11 hermetically sealing closure 230.

Figure 12:
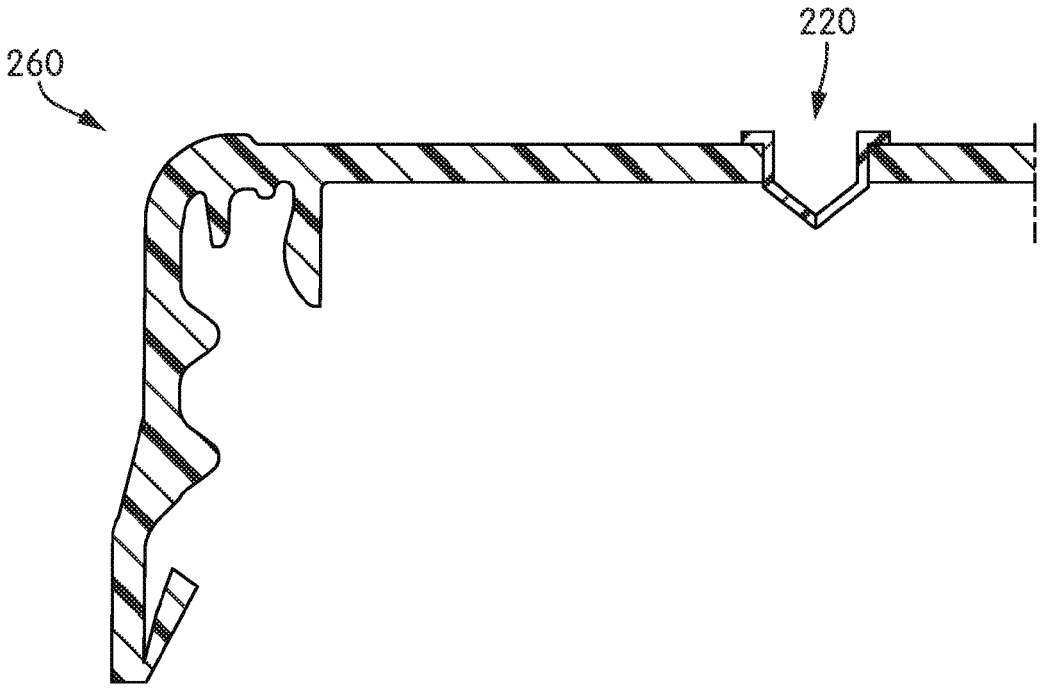
FIG. 12 is a closure used with the system of FIG. 1 according to an exemplary embodiment.
Figure 13:
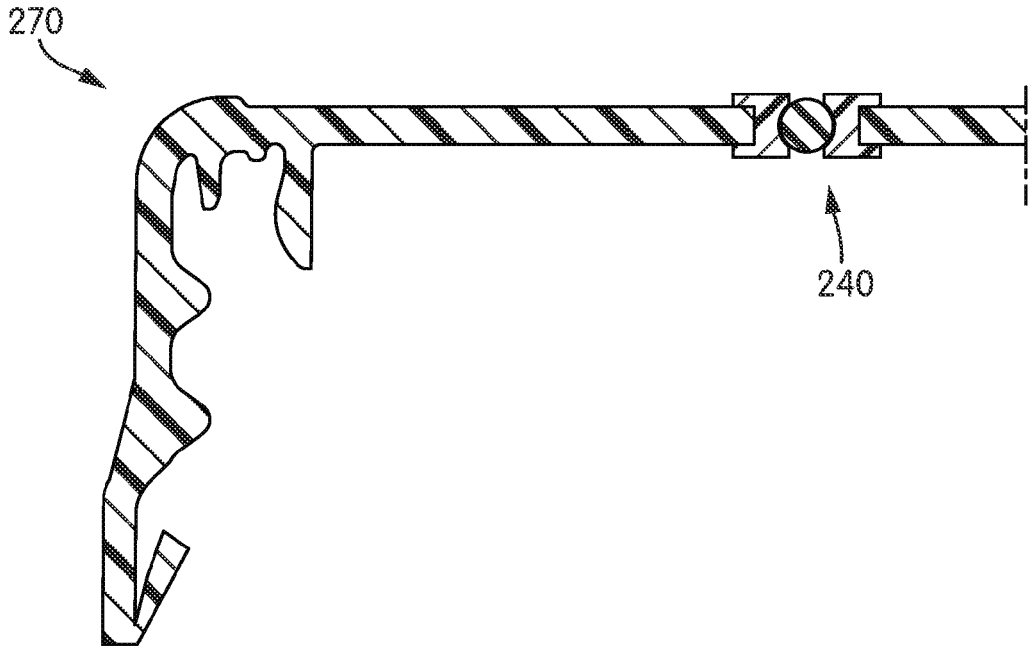
FIG. 13 is a closure used with the system of FIG. 1 according to an exemplary embodiment.

Referring to FIG. 12, a closure 260 is shown. Closure 260 is substantially similar to closure 170 shown in FIG. 8 except closure 260 includes no liner and includes flap valve 220 coupled to a bore through the top panel of closure 260. Referring to FIG. 13, closure 270 is shown. Closure 270 is substantially similar to closure 170 shown in FIG. 8 except closure 270 includes no liner and includes ball check valve 240 coupled to a bore through the top panel of closure 260.

In various embodiments, the containers discussed herein are any hermetically sealed or sealable container. In various embodiments, the containers discussed herein are containers configured to hold consumable or edible products (e.g., beverages, water, food, etc.). In the embodiment shown in FIG. 1, the container is a molded (e.g., blow-molded) thermoplastic beverage container configured to hermetically hold a beverage (e.g., soda, water, juice, fortified or nutrient water, tea, sports drink, energy drink, milk, milk-based beverages, etc.). In addition, the closures discussed herein are closures suitable for maintaining a hermetic seal. In particular embodiments, the closures discussed herein are injection molded thermoplastic closures.

It should be understood that the figures illustrate the exemplary embodiments in detail, and it should be understood that the present application is not limited to the details or methodology set forth in the description or illustrated in the figures. It should also be understood that the terminology is for the purpose of description only and should not be regarded as limiting.

Further modifications and alternative embodiments of various aspects of the invention will be apparent to those skilled in the art in view of this description. Accordingly, this description is to be construed as illustrative only. The construction and arrangements, shown in the various exemplary embodiments, are illustrative only. Although only a few embodiments have been described in detail in this disclosure, many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter described herein. Some elements shown as integrally formed may be constructed of multiple parts or elements, the position of elements may be reversed or otherwise varied, and the nature or number of discrete elements or positions may be altered or varied. The order or sequence of any process, logical algorithm, or method steps may be varied or re-sequenced according to alternative embodiments. Other substitutions, modifications, changes and omissions may also be made in the design, operating conditions and arrangement of the various exemplary embodiments without departing from the scope of the present invention.

While the current application recites particular combinations of features in the claims appended hereto, various embodiments of the invention relate to any combination of any of the features described herein whether or not such combination is currently claimed, and any such combination of features may be claimed in this or future applications. Any of the features, elements, or components of any of the exemplary embodiments discussed above may be used alone or in combination with any of the features, elements, or components of any of the other embodiments discussed above.

What is claimed is:

1. A fluid injection method for pressurizing a filled and sealed food or beverage container comprising:
- providing a container having an opening and cavity;
- filling the container cavity through the opening with a food or beverage product;
- providing an injection molded thermoplastic closure, the closure including:
  - a top panel;
  - a skirt extending downward away from the top panel; and
  - a thermoplastic elastorner liner coupled to a lower surface of the top panel, the liner comprising:
    - a central portion having a first thickness and an outer portion located radially outward of the central portion and having a second thickness;
    - wherein the first thickness is between 0.010 and 0.110 inches and the first thickness is more than twice the second thickness; and
    - a sealing rib extending downwardly relative to the outer portion and configured to contact an inner rim of the container;
- sealing the container opening with the closure, the container having a first internal pressure following sealing of the container with the closure;
- after filling and sealing the container, inserting a nozzle into the cavity of the container by piercing through the top panel and the central portion of the thermoplastic elastomer liner;
- injecting a pressurizing fluid through the nozzle into the container cavity after sealing and filling;
- controlling the injection of the pressurizing fluid with a valve and control, system; and
- removing the nozzle from the thermoplastic elastomer liner, wherein the central portion of the thermoplastic elastomer liner self-seals forming a hermetic seal after withdrawal of the nozzle, wherein the container has a second internal pressure after injection of the pressurized fluid and removal of the nozzle, wherein the second internal pressure is greater than the first internal pressure.

2. The fluid injection method of claim 1 wherein the pressurizing fluid is a sterile inert gas.

3. The fluid injection method of claim 1 wherein the pressurizing fluid is nitrogen gas.

4. The fluid injection method of claim 1 further comprising inspecting the injection nozzle for defects following withdrawal of the injection nozzle.

5. The fluid injection method of claim 1 further comprising inspecting the closure and container for defects following withdrawal of the injection nozzle.

6. The fluid injection method of claim 1 further comprising sterilizing the closure following sealing and prior to injection of the pressurized fluid.

7. The fluid injection method of claim 1, wherein the valve is a solenoid actuated check valve.

8. A fluid injection method for pressurizing a filled and sealed food or beverage container comprising:
- providing a container having an opening and cavity;
- filling the container cavity through the opening with a food or beverage product;
- providing an injection molded thermoplastic closure, the closure including:
  - a top panel having a thickness;
  - a skirt extending downward from the top panel; and
  - a thermoplastic elastomer liner coupled to a lower surface of the top panel, the liner comprising:
    - a central portion having a thickness;
    - an outer portion located radially outward of the central portion and having a thickness that is less than the thickness of the central portion;
    - wherein the thickness of the central portion is between 0,010 and 0.060 inches and is substantially the same as the thickness of the top panel; and
    - a sealing rib extending downwardly relative to the outer portion and configured to contact an inner rim of the container;
- scaling the container opening with the closure, the container having a first internal pressure following sealing of the container with the closure;
- after filling and sealing the container, inserting a nozzle into the cavity of the container by piercing through the top panel and the central portion of the thermoplastic elastomer liner;
- injecting a pressurizing fluid through the nozzle into the container cavity after sealing and filling;
- controlling the injection of the pressurizing fluid with a valve and control system; and
- removing the nozzle from the thermoplastic elastomer liner, wherein the central portion of the thermoplastic elastomer liner self-seals forming a hermetic seal after withdrawal of the nozzle, wherein the container has a second internal pressure after injection of the pressured fluid and removal of the nozzle, wherein the second internal pressure is greater than the first internal pressure.

9. The fluid injection method of claim 8 wherein the pressurizing fluid is a sterile inert gas.

10. The fluid injection method of claim 8 wherein the pressurizing fluid is nitrogen gas.

11. The fluid injection method of claim 8 further comprising inspecting the injection nozzle for defects following withdrawal of the injection nozzle.

12. The fluid injection method of claim 8 further comprising inspecting the closure and container for defects following withdrawal of the injection nozzle.

13. The fluid injection method of claim 8 further comprising sterilizing the closure following sealing and prior to injection of the pressurized fluid.

14. The fluid injection method of claim 8, wherein the valve is a solenoid actuated check valve.

15. A fluid injection method for pressurizing a filled and sealed food or beverage container comprising:
- providing a container having an opening and cavity;
- filling the container cavity through the opening with a food or beverage product;
- providing an injection molded thermoplastic closure, the closure including:
  - a top panel having a thinned central portion;
  - a skirt extending downward from the top panel; and
  - a thermoplastic elastomer liner coupled to a lower surface of the top panel, the liner comprising:
    - a central portion located within the thinned central portion of the top panel and having a thickness between 0.010 and 0.110 inches;

an outer portion located radially outward of the liner central portion and having a thickness that is less than the thickness of the liner central portion; and a sealing rib extending downwardly relative to the outer portion and configured to contact an inner rim of the container;

scaling the container opening with the closure, the container having a first internal pressure following sealing of the container with the closure;

after filling and sealing the container, inserting a nozzle into the cavity of the container by piercing through the top panel and the central portion of the thermoplastic elastomer liner;

injecting a pressurizing fluid through the nozzle into the container cavity after sealing and filling;

controlling the injection of the pressurizing fluid with a valve and control system; and removing the nozzle from the thermoplastic elastomer liner, wherein the central portion of the thermoplastic elastomer liner self-seals forming a hermetic seal after withdrawal of the nozzle, wherein the container has a second internal pressure after injection of the pressurized fluid and removal of the nozzle, wherein the second internal pressure is greater than the first internal pressure.

16. The fluid injection method of claim 15 wherein the pressurizing fluid is a sterile inert gas.

17. The fluid injection method of claim 15 wherein the pressurizing fluid is nitrogen gas.

18. The fluid injection method of claim 15 further comprising inspecting the injection nozzle for defects following withdrawal of the injection nozzle.

19. The fluid injection method of claim 15 further comprising inspecting the closure and container for defects following withdrawal of the injection nozzle.

20. The fluid injection method of claim 15 further comprising sterilizing the closure following sealing and prior to injection of the pressurized fluid.

* * * * *